United States Patent [19]

Voegeli

[11] 4,135,375

[45] Jan. 23, 1979

[54] LOCKING MECHANISM FOR CABINET ENCLOSURE

[76] Inventor: Ronald C. Voegeli, 918 Gibbs Rd., Venice, Fla. 33595

[21] Appl. No.: 800,394

[22] Filed: May 25, 1977

[51] Int. Cl.[2] ..... B65D 43/20; B65D 55/14; E05B 65/00

[52] U.S. Cl. ..... 70/77; 70/78; 220/210; 220/346; 232/16; 232/43.1; 248/322; 312/306

[58] Field of Search ..... 248/306, 322, 301; 49/449, 450, 407, 379; 70/63, 38 A, 39, 52, 77, 78, 95, DIG. 34, 160, 163, 97, 99, 100; 312/306, 215, 312; 232/16, 15, 43.1, 43.3; 217/60–61, 63; 220/210, 351, 345, 346, 335, 85 CH

[56] References Cited

U.S. PATENT DOCUMENTS

| | | | |
|---|---|---|---|
| 734,255 | 7/1903 | Chase | 217/60 D |
| 800,648 | 10/1905 | Higinbotham | 70/100 |
| 1,155,261 | 9/1915 | Mitchell | 220/85 CH |
| 1,284,518 | 11/1918 | Whitworth | 292/78 |
| 1,589,771 | 6/1926 | Tucker | 220/85 CH |
| 1,907,625 | 5/1933 | Vogt | 70/DIG. 20 |
| 2,445,394 | 7/1948 | Giralt | 312/312 |
| 2,511,253 | 6/1950 | Fischer | 70/78 |
| 3,161,923 | 12/1964 | Crain | 49/449 |
| 3,268,195 | 8/1966 | Hoffman | 248/301 |
| 3,312,442 | 4/1967 | Moeller | 248/301 |
| 3,315,023 | 4/1967 | Davis | 220/210 |
| 3,543,441 | 12/1970 | LaPorte | 49/450 |
| 3,734,335 | 5/1973 | Lincoln | 220/210 |
| 3,812,279 | 5/1974 | Voegeli | 220/210 |
| 3,945,228 | 3/1976 | Voegeli | 70/39 |
| 3,945,530 | 3/1976 | Bozich | 220/329 |
| 4,028,914 | 6/1977 | Saele et al. | 220/210 |

*Primary Examiner*—Stephen P. Garbe
*Assistant Examiner*—Allan N. Shoap
*Attorney, Agent, or Firm*—Bacon & Thomas

[57] ABSTRACT

A locking mechanism for a cabinet enclosure is comprised of a locking member in reciprocable, captured engagement with a first of a plurality of side walls defining the enclosure, a latch support disposed within the enclosure, and a latching member borne upon that support for operative engagement with the locking member. Also provided is a panel support member in pivotal, depending engagement from the latch support for supporting a side wall of the enclosure when the same is raised to an access position.

5 Claims, 6 Drawing Figures

Fig. 1.
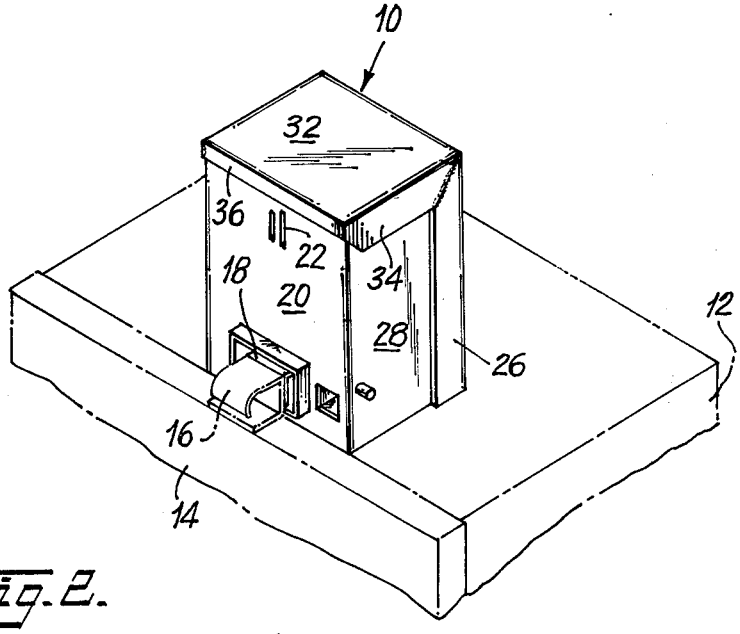
Fig. 2.
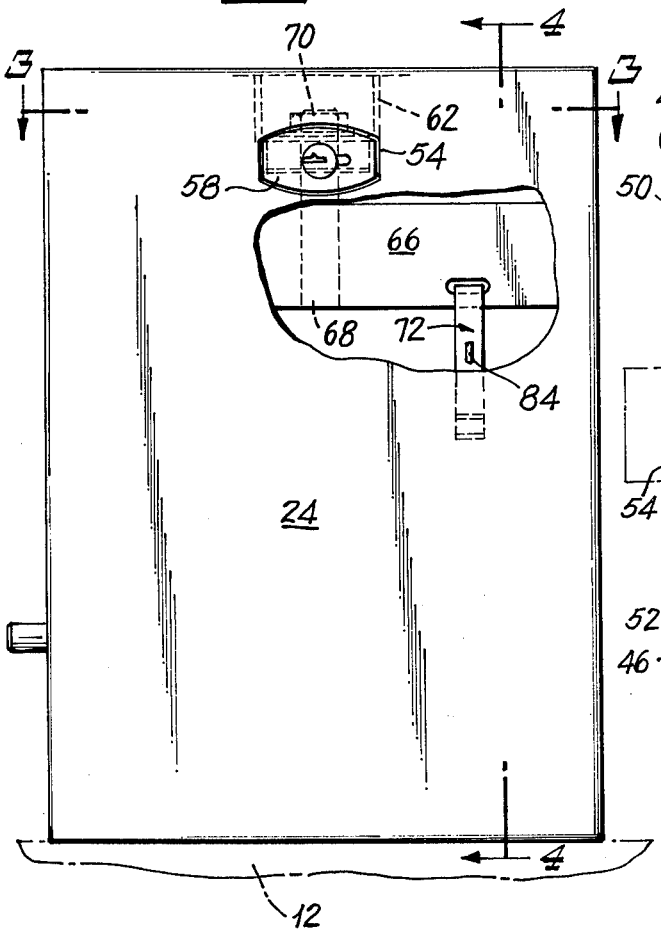
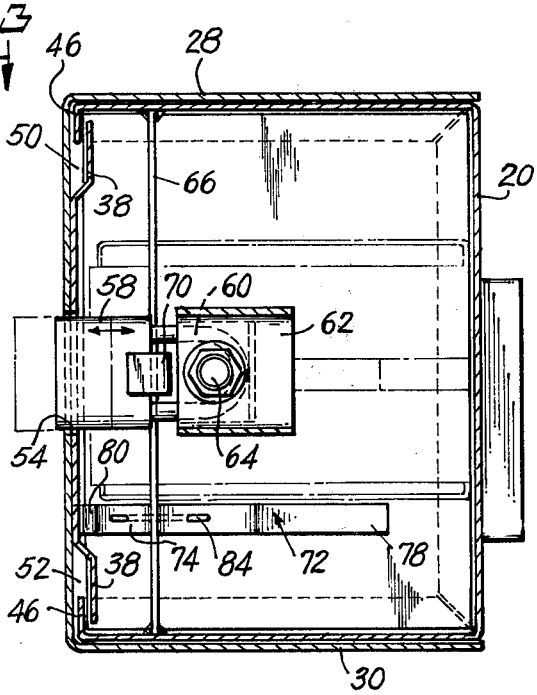
Fig. 3.

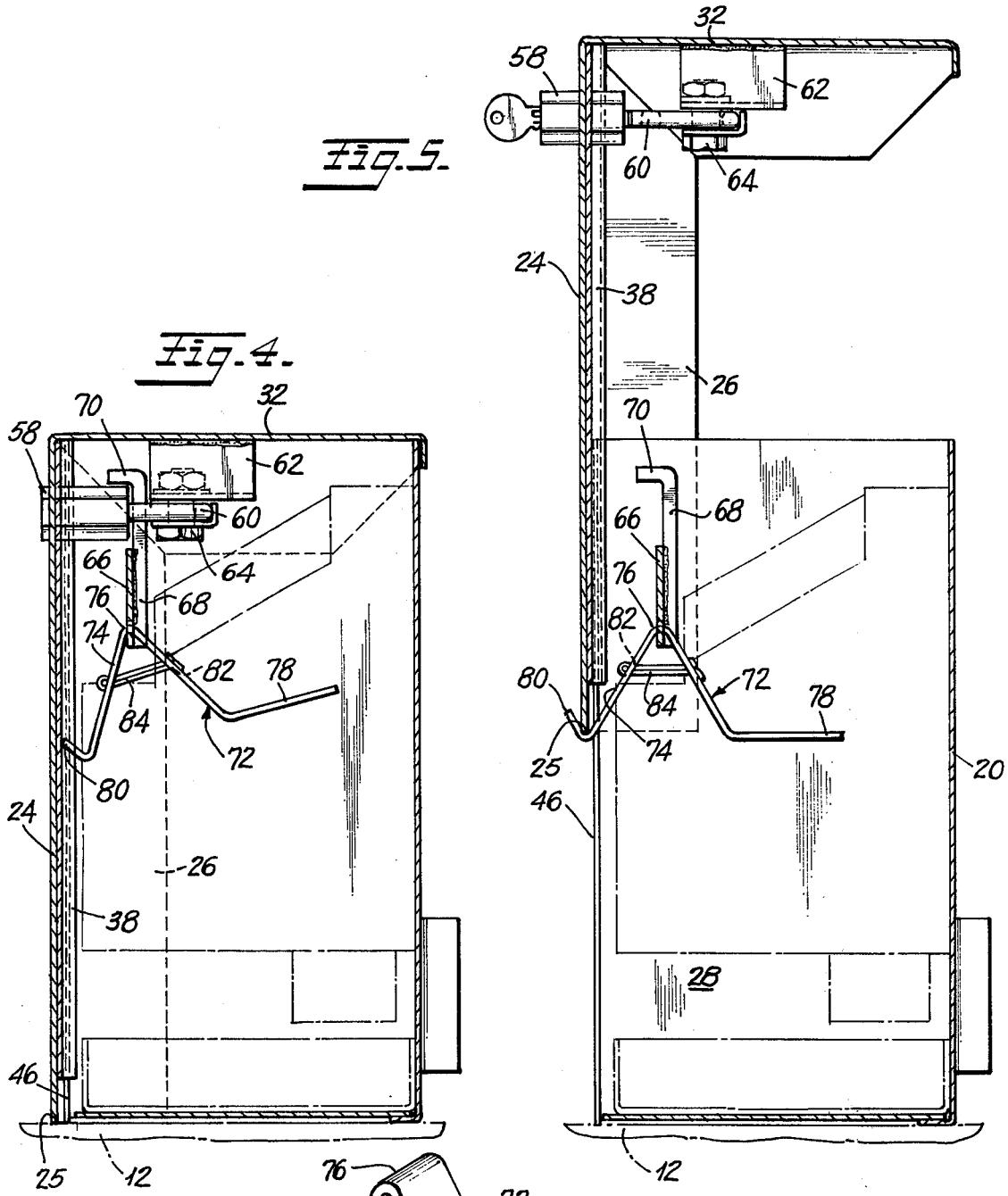
Fig. 5.
Fig. 4.
32
58
62
60
64
24
38
26
70
66
68
76
82
74
78
84
72
80
25
46
20
28
12
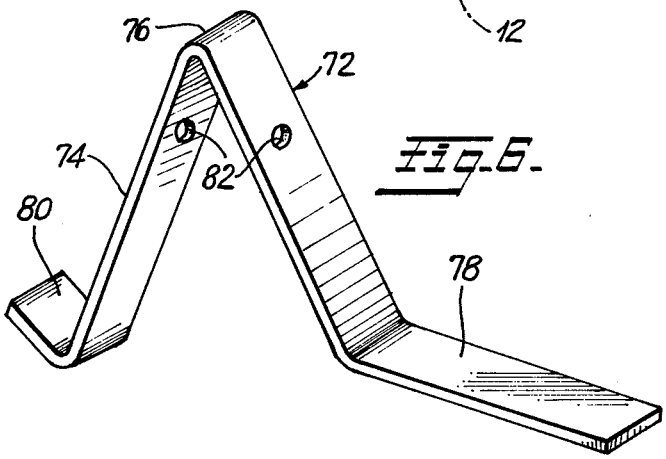
Fig. 6.
76
72
74
82
80
78

LOCKING MECHANISM FOR CABINET ENCLOSURE

CROSS-REFERENCE TO RELATED PATENT

The present invention is an improvement over that of U.S. Pat. No. 3,945,228 to H. C. Voegeli.

BACKGROUND OF THE INVENTION

1. Field of the Invention

The present invention relates, broadly, to an improved locking mechanism for cabinet enclosures and, more particularly, to locking mechanisms for the coin-receiving enclosure of a vending machine. The improved locking mechanism of the present invention is especially adapted for coin-operated newspaper vending machines.

2. Description of the Prior Art

Vending machines are, of course, well known and routinely employed to allow purveyors to widely distribute their goods to consumers at numerous, often remote locations without the need to incur expenses relating to, for example, overhead and personnel. These devices are particularly attractive for the merchant who desires to sell small, low profit-margin products widely used by consumers who desire the convenience of obtaining these goods readily during their daily routines.

However, with such widespread use of coin-operated vending machines, the merchant must be able to rely upon sturdiness of the apparatus to protect both the commodity to be dispensed and the currency deposited therein. This is particularly true for vending machines such as, for example, those employed for the dispensing of newspapers and which are typically located on numerous street corners throughout a city. Consequently, vandalism and theft become active concerns for these merchants.

In addition, the coin-receiving enclosure of these devices must not only be sturdy and durable, but convenient in terms of the ability to gain access thereto. Those vending machines currently available have not satisfactorily balanced these various considerations, but have sacrified one in favor of another. Consequently, the merchant must either suffer certain deficiencies or extensively modify the apparatus to meet his particular needs. Therefore, the need exists to provide a locking mechanism for a cabinet enclosure of vending machine which is convenient, and yet provides an increased measure of security for the merchant's investment.

While the earlier U.S. Pat. No. 3,945,228 to H. C. Voegeli materially improved the state of the art respecting these locking mechanisms, convenient access to the coin-receiving enclosure is not optimum. In that patent, wherein the locking mechanism is comprised of a removable lock body from a stationary lock shaft, the vendor must necessarily totally disengage the lock body member from the dispensing apparatus. Elimination of this somewhat undesirable feature will accommodate the present needs in the market place.

SUMMARY OF THE INVENTION

In accordance with the noted deficiencies of prior art locking mechanisms, it is a primary object of the present invention to provide a locking mechanism for a cabinet enclosure which is secure, durable, and yet permits convenient access thereto.

It is also an object of the present invention to provide a durable locking mechanism for a coin-operated vending machine, which locking mechanism provides tamper-proof security in a simple, yet efficient and convenient manner.

It has now been determined, in accordance with the present invention, that the foregoing objects may be realized by providing a cabinet enclosure with a locking member reciprocably captured by one of the side walls of the enclosure, the lock being capable of reciprocable engagement with a latching member borne upon a latch support disposed within the enclosure. Because the lock is captured, it may be viewed as an integral part of the enclosure itself, thereby obviating the problems attendant the use of a separable lock body. Additionally, a panel support member is disposed in pivotal depending engagement from the latch support, and includes at least one arm which terminates in a hook or the like for supporting a side wall of the cabinet enclosure when it is in an access configuration.

Yet further objects and advantages of the present invention will become apparent to the skilled artisan upon examination of the following detailed description of the invention, taken in conjunction with the Figures of Drawing, wherein:

BRIEF DESCRIPTION OF THE DRAWINGS

FIG. 1 is an isometric view of a cabinet enclosure in accordance with the present invention, adapted for use in conjunction with a newspaper vending rack;

FIG. 2 is an enlarged rear elevational view of the enclosure of FIG. 1, with portions broken away for purposes of clarity;

FIG. 3 is a horizontal sectional view, taken substantially along the line 3—3 of FIG. 2;

FIG. 4 is a vertical sectional view, taken substantially along the line 4—4 of FIG. 2, showing the enclosure in its locked position and the panel support member in an inoperative position;

FIG. 5 is a vertical sectional view, similar to FIG. 4, but showing the enclosure in its unlocked, access position whereby a side wall is supported by the panel support member; and, FIG. 6 is an enlarged perspective view of the pivotal panel support member.

DETAILED DESCRIPTION OF THE PREFERRED EMBODIMENT

In order to more fully elucidate upon the various objects and advantages of the present invention, the same will be described in terms of an exemplary, preferred embodiment thereof. Along these lines, the following description will be given with reference to a newspaper vending machine, it being appreciated by the skilled artisan that the same is illustrative and in no wise limitative.

FIG. 1 shows, perspectively, a coin-receiving enclosure, designated generally as 10, affixed to a, e.g., newspaper vending rack 12. The rack 12 is provided with a pivotal front panel or door 14 having disposed thereon a rack latch 16 inserted through an aperture 18 in the front wall 20 of enclosure 10. When it is desired to dispense an, e.g., newspaper, the consumer merely deposites the appropriate coins in a coin-receiving slot 22 in front wall 20 and, through appropriate mechanisms within enclosure 10 (not shown), latch 16 is freed whereby the front panel 14 may be disengaged from the rack 12.

Enclosure 10 receives and retains the deposited coins, and is defined by a plurality of upstanding walls, in addition to front wall 20. Thus, there is a rear wall 24, best viewed in FIGS. 2 and 3, which is provided with opposing skirts 26 partially overlapping side walls 28 and 30. Top wall 32, which is integral with rear wall 24, is likewise formed with skirt members 34 which also partially overlap side walls 28 and 30, and a front skirt 36 partially overlapping front wall 20.

Rear wall 24 is formed as a double thickness, as best viewed in FIG. 3, whereby a pair of opposing ears 38 project from the terminal ends of an interior panel 40. Side walls 28, 30 also terminate in cooperating ears 46 which project substantially perpendicularly therefrom. In this manner, a pair of opposing channels 50 are defined, whereby side wall 24 and attached top wall 32 may be vertically displaced with respect to fixed side walls 28, 30 and front wall 20, as viewed, for example, in FIGS. 4 and 5.

Rear wall 24 is formed with an aperture 54 for receiving a lock 56 in captured, reciprocable engagement therewith. Lock 56 is comprised of a lock body member 58 and a cooperating lock shaft member 60, as is conventional with, e.g., padlocks. Lock 56 is affixed to top wall 32 by a fixture plate 62 and cooperating fixture fastener 64, whereby the lock shaft member 60 is maintained stationary with respect to reciprocable lock body member 58. An internal spring (not shown) biases lock body member 58 away from the lock shaft members 60 whereby operation of the lock will result in a static configuration in the unlocked position as best viewed in FIG. 5.

Disposed interiorly of enclosure 10 is a latch support member 66 which traverses the enclosure between side walls 28 and 30. Borne upon latch support 66 is a latch member 68, which terminates in a latch hook 70, as best viewed in FIGS. 4 and 5, for cooperative engagement with lock body member 58. Thus, when the enclosure is in its normally closed position, as shown in FIG. 4, latch member 68 protrudes through the aperture defined by generally U-shaped shaft member 60 allowing latch hook 70 to rest proximate lock body member 58. Consequently, movement of rear wall 24 and top wall 32 is precluded. Access to the interior of enclosure member 10 is achieved by unlocking lock member 56 whereby lock body member 58 is biased outwardly with respect to lock shaft member 60, effectively increasing the size of the aperture defined thereby and permitting disengagement of lock body member 58 from latch hook 70, as shown in FIG. 5.

Pivotally depending from latch support 66 is a panel support member 72, illustrated perspectively in FIG. 6. As best viewed in FIGS. 4–6, the panel support member is comprised of a substantially V-shaped central portion 74 terminating at an apex 76. A first outwardly extending arm 78 projects from one end of central portion 74 and a terminal hook 80 projects from the opposite end thereof. Central portion 74 is further provided with a pair of registering apertures 82 for receiving a cotter key 84, or the like, to prevent the panel support 72 from being dislodged from its operative pivotal engagement from apex 76 on latch support 66 when enclosure 10 is closed. As viewed in FIG. 4, the panel support member 72 is an inoperative configuration when the integral panel comprised of rear wall 24 and top wall 32 is in a closed position and, due to the length of projecting arm 78, is gravitationally biased against rear wall 24. When the merchant desires access to enclosure 10, and raises the panel comprised of rear wall 24 and top wall 32 to an access position as shown in FIG. 5, the terminal edge 25 of rear wall 24 will pass above support hook 80 and panel support member 72 will be allowed to project beyond the plane of rear wall 24 whereby edge 25 may rest against support hook 80.

In its normally closed position, enclosure 10 is highly durable and provides a greater measure of security for the contents thereof than prior art devices. Because the lock body member 58 may be positioned within aperture 54 in such a fashion that the lock face is flush with the plane of rear wall 24, tampering with the mechanism is substantially minimized. Furthermore, due to the positive interengagement between lock body member 58 and latch hook 70, the ability to pry the enclosure open is likewise minimized.

When the merchant desires access to enclosure 10, he need merely unlock member 56, which forms a convenient point for grasping the panel when in the outwardly biased position, whereby the panel may be raised to an access position. The panel is thus supported by pivotal support member 72 to provide convenient access unattainable from prior art devices. Accordingly, access may be achieved with only one hand, a feature highly desirable since it frees the merchant's other hand. Closure of the enclosure 10 is achieved merely by lifting edge 25 from support hook 80 and displacing panel support 72 inwardly whereby the rear wall 24 and top wall 32 may be returned to a closed configuration.

Obviously, the enclosure 10 may be designed in any one of a number of ways, particularly with respect to the placement of lock 56 or the manner of forming an integral panel from rear wall 24 and top wall 32. Thus, the skilled artisan will readily appreciate that various modifications, substitutions, changes, and omissions may be made with respect to the exemplary embodiment disclosed herein without departing from the spirit thereof. Accordingly, it is intended that the scope of the present invention be limited solely by that of the appended claims.

What is claimed is:

1. In a cabinet enclosure defining a top wall and a plurality of upstanding side walls, and having closed and access configurations, one of said walls forming a panel that is slidably received by others of said walls, the improvement comprising a locking mechanism thereof, said mechanism comprising:

(a) locking means reciprocally captured for linear motion by said wall forming said panel, said locking means comprising a lock shaft member and a cooperating lock body member defining an aperture of variable dimension therebetween, said lock shaft member being fixedly attached to said panel, and said lock body member being reciprocally received through said panel;

(b) a latch support disposed interiorly of, and attached to, said enclosure, and fixed relative to said slidable panel; and (c) fixed latching means attached to said latch support for cooperative engagement with said locking means, said latching means including hook means adapted to project through said aperture and to be captured by said lock body member when said enclosure is in a closed and locked configuration.

2. The enclosure of claim 1, wherein said one of said walls forming said panel is a first one of said upstanding side walls, said top wall and said first one of said upstanding side walls being integral and forming a wall unit slidably received by opposing side walls adjacent said first of said side walls, and said lock shaft member being fixedly attached by bracket means to said top wall.

3. In a cabinet enclosure defining a top wall and a plurality of upstanding side walls, and having closed and access configurations, said top wall and a first of said side walls being integral and forming a panel slidably received by opposing side walls adjacent said first of said side walls, the improvement comprising a locking mechanism thereof, said mechanism comprising:

(a) locking means reciprocally captured for linear motion by said first of said side walls, said locking means comprising a lock shaft member and a cooperating lock body member defining an aperture of variable dimension therebetween, said lock shaft member being fixedly attached to said first of said side walls, and said lock body member being reciprocally received through said first of said side walls;

(b) a latch support disposed interiorly of, and attached to, said enclosure; and (c) fixed latching means attached to said latch support for cooperative engagement with said locking means, said latching means including an arm terminating in a latching hook, said arm being adapted to project through said aperture and said hook being adapted to engage said lock body member when said enclosure is in a closed and locked configuration.

4. In a cabinet enclosure defining a top wall and a plurality of upstanding side walls, and having closed and access configurations, the improvement comprising a locking mechanism thereof, said mechanism comprising:

(a) locking means reciprocally captured for linear motion by a first of said side walls;

(b) a latch support disposed interiorly of, and attached to, said enclosure;

(c) fixed latching means attached to said latch support for cooperative engagement with said locking means; and (d) side wall support means in pivotal depending engagement from said latch support, said side wall support means being biased outwardly of said enclosure and including at least one projecting arm terminating in a hook element for supporting said first of said side walls when in an access configuration.

5. A support for a vertically displaceable panel having a raised and a lowered position, said support comprising a generally inverted "V"-shaped central portion and opposing arms projecting therefrom, said support being disposed in pivotal depending engagement from the apex of said "V" on horizontal suspension means, a first of said opposing arms terminating in a hook element for engaging said panel when in said raised position and a second of said arms comprising means for gravitationally biasing said support toward said panel when in said lowered position.

* * * * *